US008031900B2

(12) United States Patent
Dyer et al.

(10) Patent No.: US 8,031,900 B2
(45) Date of Patent: Oct. 4, 2011

(54) EARPHONE AMBIENT EARTIP

(75) Inventors: Medford Alan Dyer, San Diego, CA (US); Jerry J. Harvey, Newport Beach, CA (US)

(73) Assignee: Logitech International, S.A. (CH)

( * ) Notice: Subject to any disclaimer, the term of this patent is extended or adjusted under 35 U.S.C. 154(b) by 1434 days.

(21) Appl. No.: 11/363,006

(22) Filed: Feb. 27, 2006

(65) Prior Publication Data

US 2007/0201717 A1 Aug. 30, 2007

(51) Int. Cl.
*H04R 25/00* (2006.01)

(52) U.S. Cl. ..... 381/380; 381/381; 381/322; 381/328; 181/130; 181/135

(58) Field of Classification Search ..... 381/312, 381/322–330, 380–381; 181/130, 135
See application file for complete search history.

(56) References Cited

U.S. PATENT DOCUMENTS 4,375,016 A * 2/1983 Harada ..... 181/135
5,729,605 A 3/1998 Bobisuthi et al.
7,079,662 B2 * 7/2006 Niederdr ..... 381/328
7,627,131 B2 * 12/2009 Nielsen et al. ..... 381/328
2002/0139607 A1 10/2002 Wubker
2005/0249369 A1 11/2005 Angst et al.
2006/0137934 A1 * 6/2006 Kurth ..... 181/135

* cited by examiner

*Primary Examiner* — Davetta W Goins
*Assistant Examiner* — Jasmine Pritchard
(74) *Attorney, Agent, or Firm* — Patent Law Office of David G. Beck

(57) ABSTRACT

An eartip that includes at least one acoustic material filled port is provided. The port and the acoustic material contained therein provide the eartip with a controlled acoustic leakage path, thus allowing the user to tailor the performance of the earphones to which the eartips of the invention are attached. The provided eartip is attachable to a standard, generic earpiece, for example through the use of interlocking members (e.g., channel/lip arrangement). At least one port, in addition to the central opening by which the eartip is attached to the earphone, extends through the eartip. The port can have a circular cross-section, arcuate cross-section, or other shape. If desired, for example to increase the port area, the eartip can be designed with multiple ports surrounding the central opening. Within the port is an acoustic material with the desired acoustic impedance. The eartip can be coded to allow identification of the acoustic qualities of a particular eartip.

19 Claims, 8 Drawing Sheets

EARPHONE AMBIENT EARTIP

FIELD OF THE INVENTION

The present invention relates generally to audio monitors and, more particularly, to an earphone eartip.

BACKGROUND OF THE INVENTION

Earphones, also referred to as in-ear monitors, canal phones and earpieces, are commonly used to listen to both recorded and live music. A typical recorded music application would involve plugging the earphone into a music player such as a CD player, flash or hard drive based MP3 player, home stereo, or similar device using the earphone's headphone jack. Alternately, the earphone can be wirelessly coupled to the music player. In a typical live music application, an on-stage musician wears the earphone in order to hear his or her own music during a performance.

Earphones are typically quite small and are worn just outside the ear canal. Prior art earphones use either one or more diaphragm-based drivers, one or more armature-based drivers, or a combination of both driver types. Broadly characterized, a diaphragm is a moving-coil speaker with a paper or mylar diaphragm. Since the cost to manufacture diaphragms is relatively low, they are widely used in many common audio products. In contrast to the diaphragm approach, an armature receiver utilizes a piston design. Due to the inherent cost of armature receivers, however, they are typically only found in hearing aids and high-end in-ear monitors.

Armature drivers, also referred to as balanced armatures, were originally developed by the hearing aid industry. This type of driver uses a magnetically balanced shaft or armature within a small, typically rectangular, enclosure. A single armature is capable of accurately reproducing low-frequency audio or high-frequency audio, but incapable of providing high-fidelity performance across all frequencies. To overcome this limitation, armature-based earphones often use two, or even three, armature drivers. In such multiple armature arrangements, a crossover network is used to divide the frequency spectrum into multiple regions, i.e., low and high or low, medium, and high. Separate armature drivers are then used for each region, individual armature drivers being optimized for each region. In contrast to the multi-driver approach often used with armature drivers, earpieces utilizing diaphragm drivers are typically limited to a single diaphragm due to the size of the diaphragm assembly. Unfortunately, as diaphragm-based monitors have significant frequency roll off above 4 kHz, an earpiece with a single diaphragm cannot achieve the desired upper frequency response while still providing an accurate low frequency response.

In addition to utilizing one or more high-fidelity drivers, professional-quality earphones are either custom molded or they use generic eartips, also referred to as sleeves. Eartips are typically fabricated from a soft, pliable material such as foam or silicon in order to achieve the desired snug fit within the user's ear canal. In use, the eartips isolate the user, thus insuring that the user can hear every nuance of the reproduced audio source by minimizing the audio interference caused by competing background noise.

Although sound isolating earphones meet the requirements of many users, for example professional musicians, some users prefer to be able to hear a degree of background sound. This preference may be for convenience, for example to hear the telephone while using the earphones, or for safety, for example to hear traffic and/or emergency vehicles while cycling. Currently users must select the type of earphone based on the intended use, or at least the primary intended use. As a result, either the user must buy multiple earphone sets to accommodate different uses, or suffer with varying performance inadequacies. The present invention is designed to overcome this problem.

SUMMARY OF THE INVENTION

The present invention provides an eartip that includes at least one acoustic material filled port, the port and the acoustic material contained therein providing the eartip with a path for controlled acoustic leakage. As a result of this controlled acoustic leakage, the user is able to tailor the performance of the earphones to which the eartips of the invention are attached, for example allowing varying levels of ambient sound to intrude upon the sound produced by the earphone, thereby limiting the sound isolation afforded by the eartip. The controlled acoustic leakage of the eartip can also be used to tailor the response of the earphone, for example lessening the earphone's base response.

The eartip of the invention is attachable to a standard, generic earphone, for example through the use of interlocking members (e.g., channel/lip arrangement). At least one port, in addition to the central opening by which the eartip is attached to the earphone, extends through the eartip. The port can have a circular cross-section, arcuate cross-section, or other shape. If desired, for example to increase the port area, the eartip can be designed with multiple ports surrounding the central opening. Within the port is an acoustic material with the desired acoustic impedance. Typical acoustic materials are fabricated from foam or fibrous material, although the invention is not limited to these materials. Preferably the eartip of the invention includes an indicator, such as color coding, that allows the user to easily identify the acoustic qualities of the selected eartip.

In one embodiment of the invention, a kit of eartip pairs of varying acoustic impedance is provided. The user selects the eartip pair based on the desired earphone performance, thus allowing the earphone frequency response and/or the degree of sound isolation to be varied as preferred.

A further understanding of the nature and advantages of the present invention may be realized by reference to the remaining portions of the specification and the drawings.

DESCRIPTION OF THE SPECIFIC EMBODIMENTS

Figure 1:
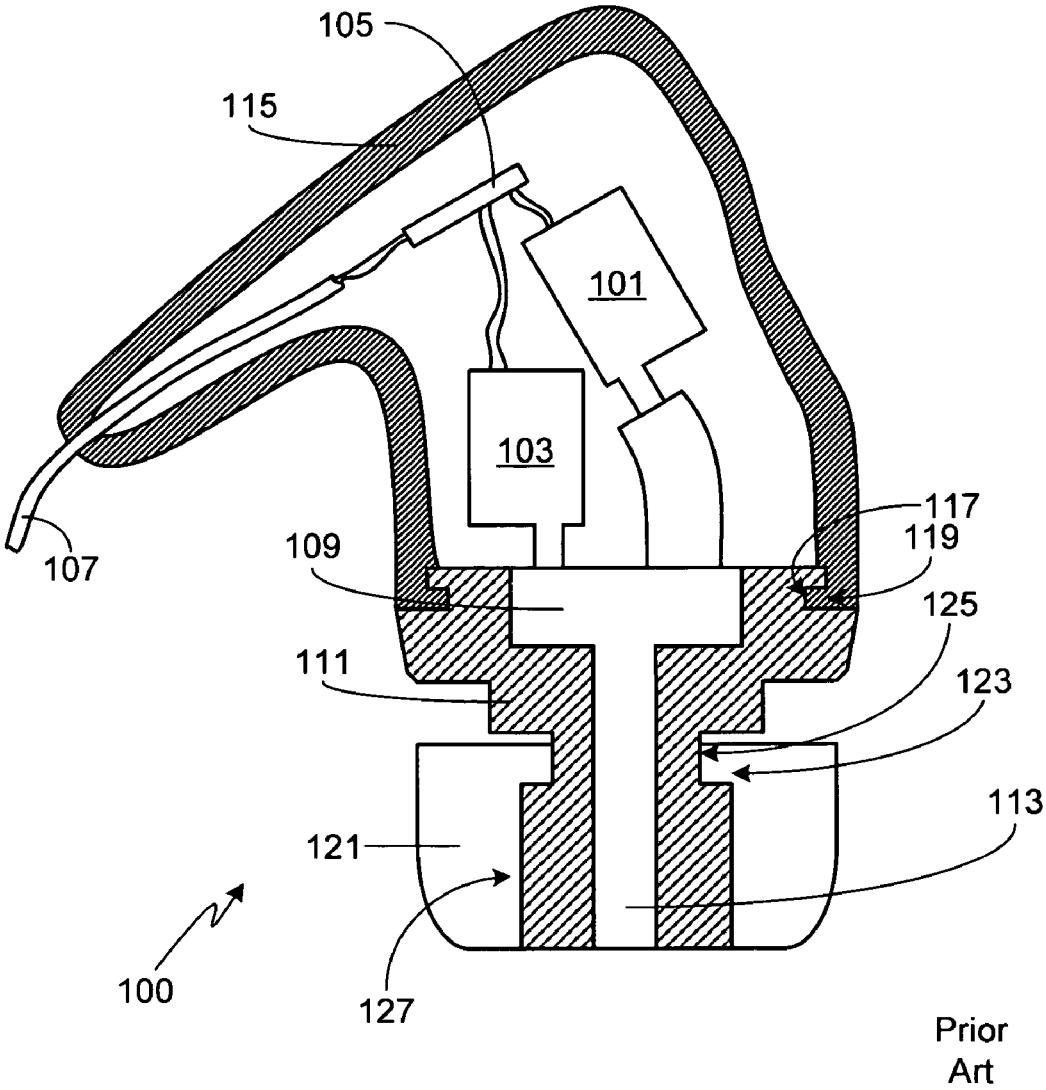
FIG. 1 is a cross-sectional view of a generic earphone in accordance with the prior art.

FIG. 1 is a cross-sectional view of a generic earphone 100 in accordance with the prior art. Earphone 100, also referred to herein as an earpiece, in-ear monitor and canalphone, includes a low-frequency driver armature driver 101 and a high-frequency armature driver 103. A circuit 105, such as a passive crossover circuit or an active crossover circuit, provides input to armature drivers 101 and 103. Crossover circuit 105 is coupled to the external sound source (not shown) via a cable 107. Only a portion of cable 107 is shown. The external sound source may be selected from any of a variety of sources such as an audio receiver, mixer, music player, headphone amplifier or other source type. As is well known in the industry, earphone 100 can also be wirelessly coupled to the desired source. Although dual armature drivers are shown in FIG. 1, it will be appreciated that the invention is equally applicable to other driver configurations, for example with fewer or greater numbers of drivers as well as those using either diaphragm drivers, armature drivers, or both.

Figure 2:
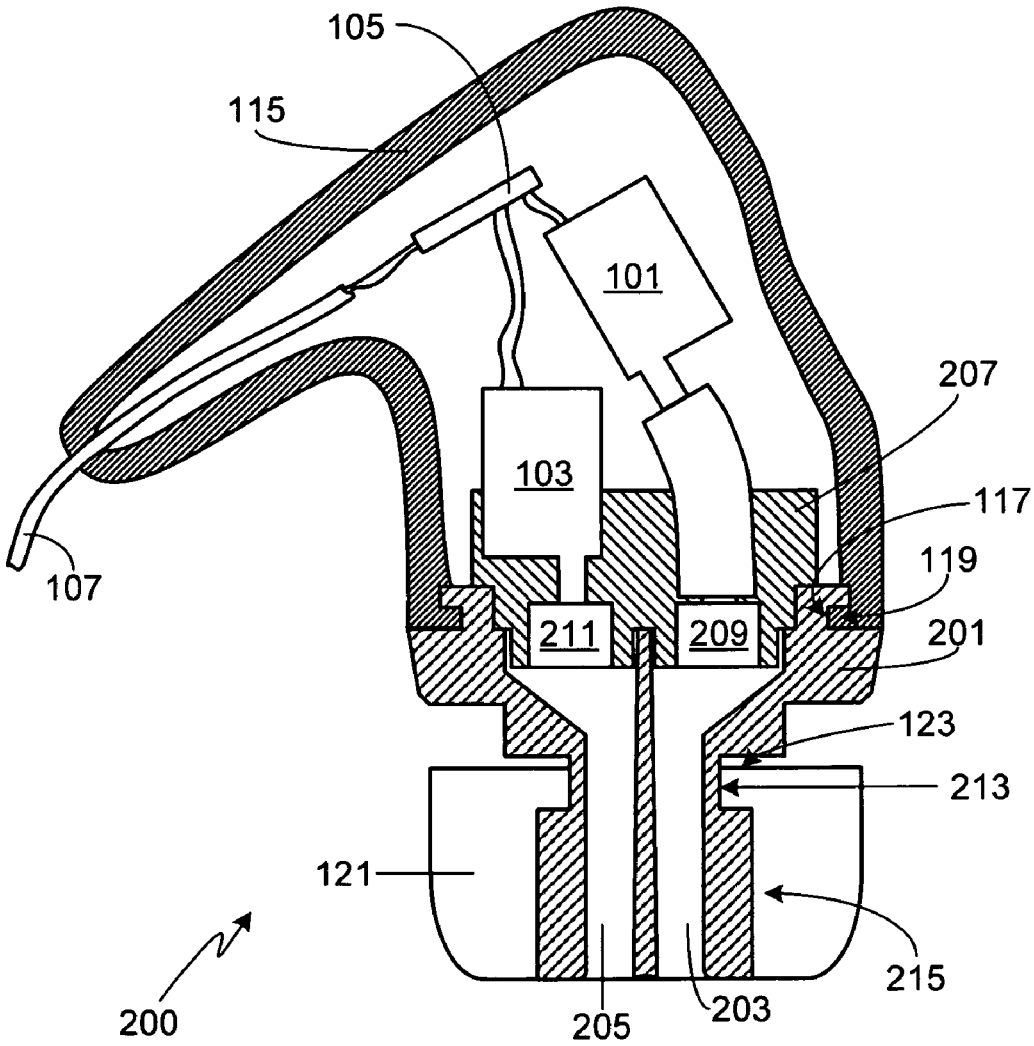
Prior Art FIG. 2
FIG. 2 is a cross-sectional view of a generic earphone with multiple sound delivery tubes in accordance with the prior art.

As illustrated, the output from each driver enters an acoustic mixing chamber 109 within sound delivery member 111. A single sound delivery tube 113 delivers the mixed audio from the two drivers through the sound delivery member 111 to the user. Sound delivery member 111 is designed to fit within the outer ear canal of the user and as such, is generally cylindrical in shape. It will be appreciated that although a single sound delivery tube 113 is shown in the embodiment illustrated in FIG. 1, the invention is not limited to earphones of this design. For example, assuming the use of multiple drivers, multiple sound delivery tubes can be used as described in co-pending U.S. patent application Ser. Nos. 11/051,865, filed Feb. 4, 2005, and 11/333,151, filed Jan. 17, 2006, the disclosures of which are incorporated herein for any and all purposes. An exemplary embodiment of a multiple sound tube configuration is shown in FIG. 2. As shown, sound delivery member 201 of earphone 200 includes two separate sound delivery tubes 203/205, corresponding to drivers 101 and 103, respectively. Preferably a boot member 207, which can also be used in other configurations such as that shown in FIG. 1, attaches to sound delivery member 201, boot member 207 securing the components to the sound delivery member.

Regardless of the configuration, earphones utilizing the present invention can include internal dampers, also commonly referred to as acoustic filters. Although not shown in FIG. 1, the embodiment illustrated in FIG. 2 includes a pair of dampers 209/211 interposed between the drivers 101/103 and sound delivery tubes 203/205. In the embodiment illustrated in FIG. 1, the damper could be located within the mixing chamber 109, for example. Dampers, interposed between the driver(s) and the sound delivery tube(s) and/or the sound delivery tube(s) and the earphone output, are often used to tune the earphone, for example by reducing the output level for a particular frequency range or reducing the overall sound pressure level.

An outer earphone enclosure 115 attaches to sound delivery member 111 (or member 201 in FIG. 2). Earphone enclosure 115 protects the drivers (e.g., drivers 101/103) and any required earphone circuitry (e.g., crossover circuit 105) from damage while providing a convenient means of securing cable 107, or a cable socket, to the earphone. Enclosure 115 can be attached to member 111 (or member 201) using interlocking members (e.g., groove 117, lip 119). Alternately, an adhesive or other means can be used to attach enclosure 115 to member 111 (or member 201). Enclosure 115 can be fabricated from any of a variety of materials, thus allowing the designer and/or user to select the material's firmness (i.e., hard to soft), texture, color, etc. Enclosure 115 can be either custom molded or designed with a generic shape.

Attached to the end portion of sound delivery member 111 (or member 201) is an eartip 121, also referred to as an eartip sleeve or simply a sleeve. Eartip 121 can be fabricated from any of a variety of materials including foam, plastic and silicon-based material. Sleeve 121 can have the generally cylindrical and smooth shape shown in FIGS. 1 and 2, or can include one or more flanges. To hold sleeve 121 onto member 111 (or member 201) during normal use but still allow the sleeve to be replaced when desired, typically the eartip includes a lip portion 123 which is fit into a corresponding channel or groove 125 in sound delivery member 111 (or groove 213 in sound delivery member 201 of FIG. 2). The combination of an interlocking groove 125 with a lip 123 provides a convenient means of replacing eartip 121, allowing sleeves of various sizes, shapes, or colors to be easily attached to the earphone. As a result, it is easy to provide the end user with a comfortable fit at a fraction of the cost of a custom fit (i.e., molded) earphone. Additionally, the use of interlocking members 123 and 125 allow worn out eartips to be quickly and easily replaced. It will be appreciated that other eartip mounting methods can be used with earphone 100. For example, eartip 121 can be attached to sound delivery member 111 using pressure fittings, bonding, etc.

Figure 3:
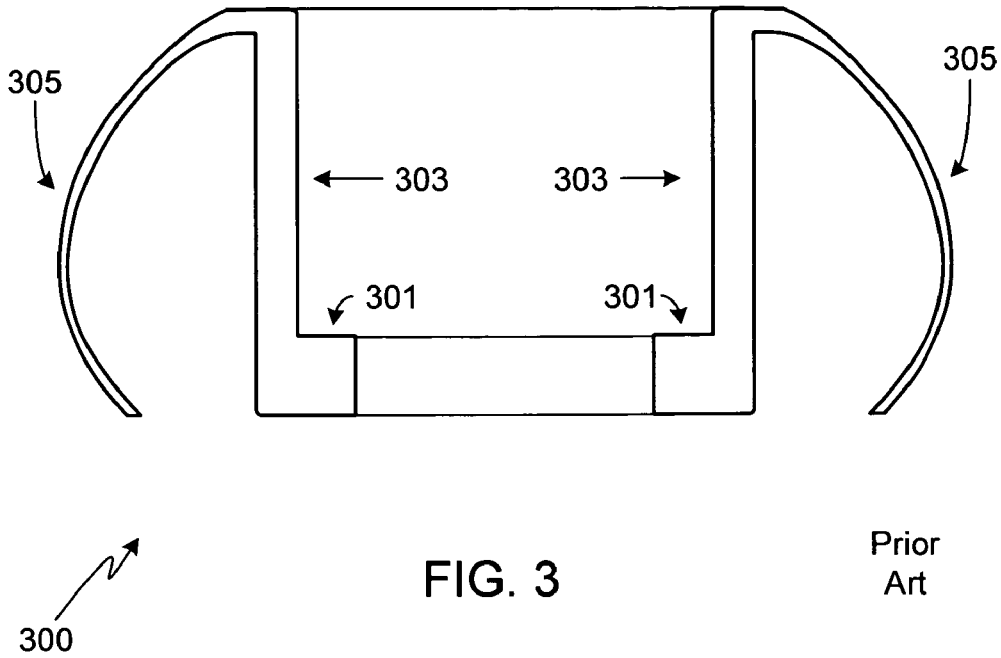
FIG. 3 Prior Art
FIG. 3 is a cross-sectional view of an alternate prior art eartip.

Although eartip 121, as illustrated in the cross-sectional views of FIGS. 1 and 2, is solid, it will be appreciated that other configurations can be used. For example, FIG. 3 is a cross-sectional view of an alternate eartip 300. As shown, preferably eartip 300 includes a lip portion 301, thus allowing it to be easily attached to the sound delivery member groove as previously described and illustrated relative to eartip 121. Portion 303 of eartip 300 is cylindrically-shaped, thus providing a secure fit against the barrel-shaped portion of the sound delivery member (e.g., portion 127 of member 111, portion 215 of member 201, etc.). Eartip 300 also includes a pliable portion 305 designed to provide both a tight and comfortable fit within the user's ear canal.

In accordance with the invention, one or more controlled acoustic leakage ports are included within the eartip. It should be appreciated that the controlled leakage ports of the invention are not simply open ports, rather they are ports that include a material selected to provide the desired acoustic impedance. Uncontrolled leakage, i.e., that resulting from an open port, is undesirable as it degrades the sound quality to an unacceptable level. Accordingly the present invention provides controlled leakage, thus achieving the benefits of a ported earphone without the significant drawbacks associated with an open port.

Figure 4:
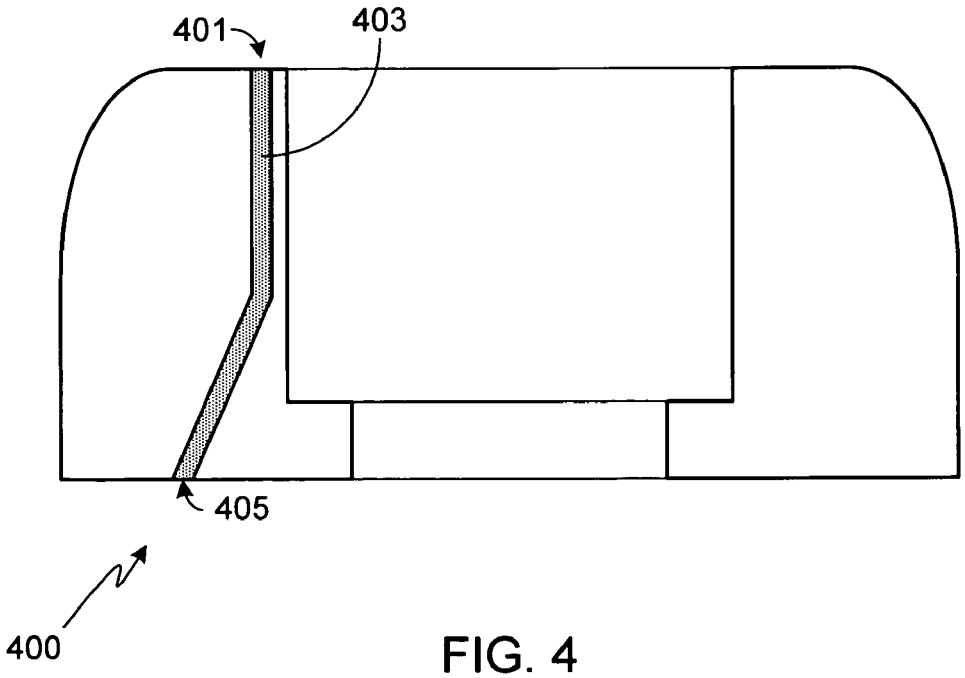
FIG. 4 is a cross-sectional view of an eartip similar to that shown in FIGS. 1 and 2, with the inclusion of a controlled leakage port.
Figure 5:
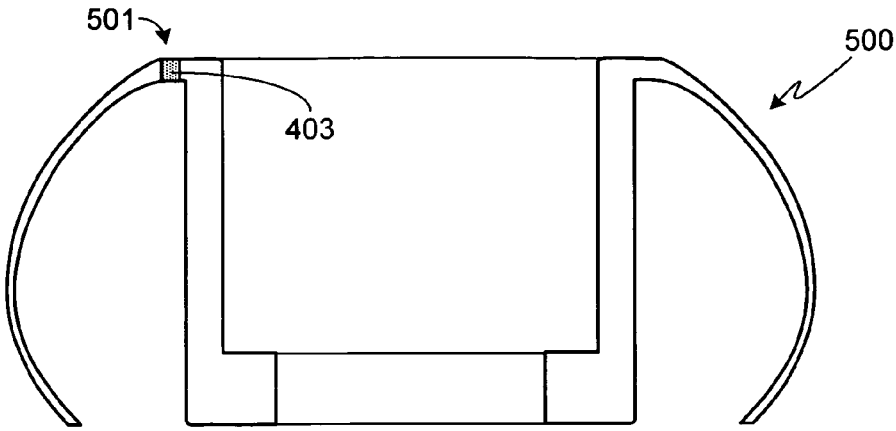
FIG. 5 is a cross-sectional view of an eartip similar to that shown in FIG. 3, with the inclusion of a controlled leakage port.
Figure 6:
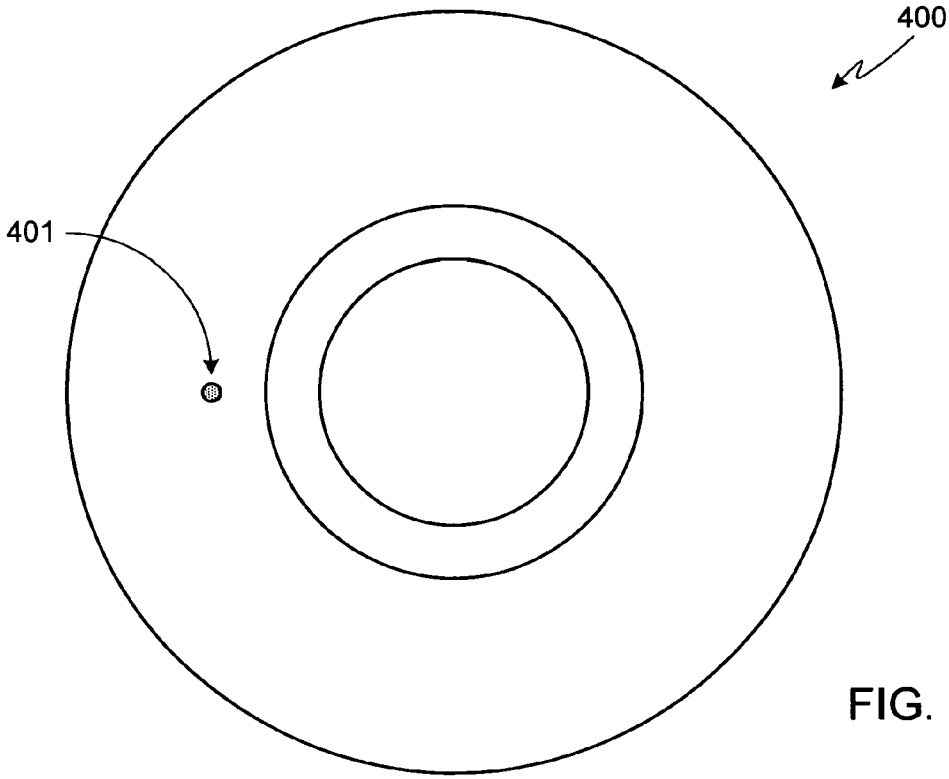
FIG. 6 is an end view of the eartip shown in FIG. 4.
Figure 7:
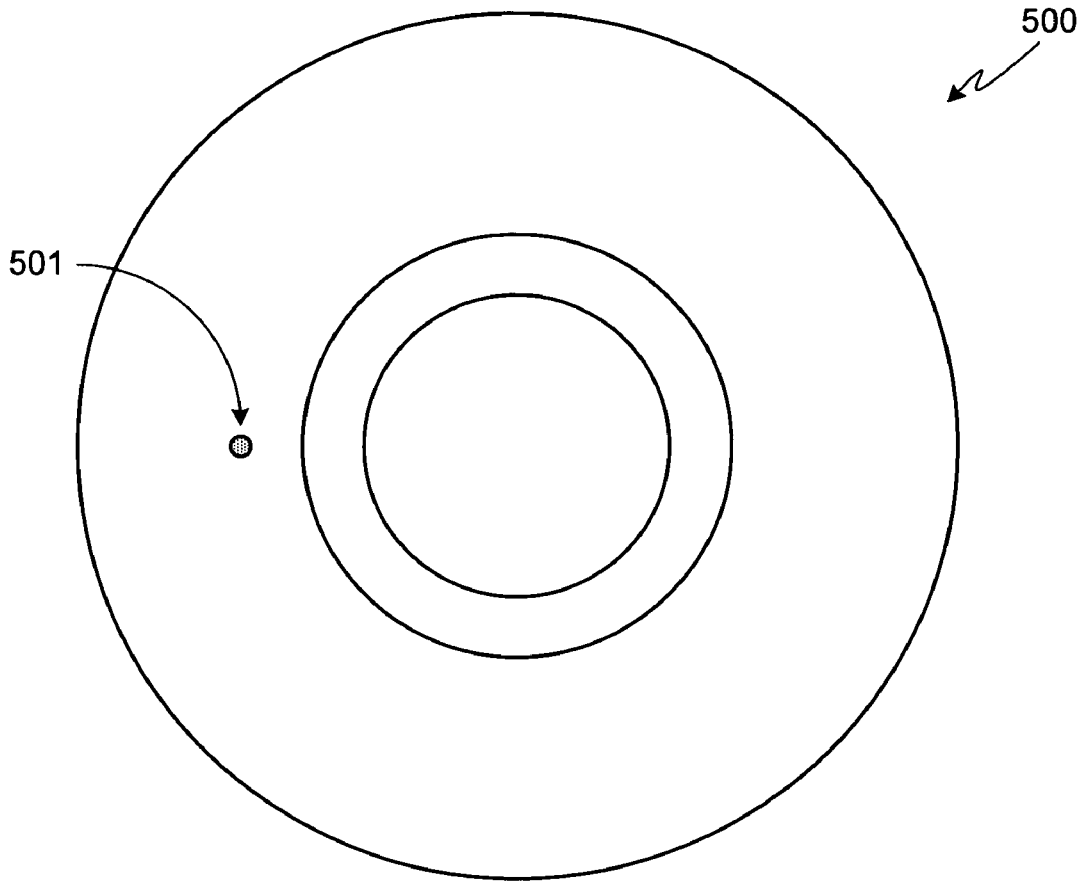
FIG. 7 is an end view of the eartip shown in FIG. 5.

FIGS. 4 and 5 are cross-sectional views of eartips 400 and 500, similar to eartips 121 and 300, respectively, except for the inclusion of controlled impedance ports 401 and 501. As shown, ports 401 and 501 are cylindrically-shaped and filled with the desired acoustic material 403. FIGS. 6 and 7 provide end views of eartips 400 and 500, respectively.

The acoustic impedance of an eartip designed in accordance with the invention depends, in part, on the area of the controlled impedance port or ports integrated into the eartip. The primary constraint placed on the available area for integrating one or more ports into the eartip is the surface area of the exit surface of the eartip that opens into the ear canal, as opposed to the side surfaces of the eartip that are immediately adjacent to, and fit against, the inner ear canal. Additionally, the back surface of the port or ports must remain unblocked when the eartip is attached to the earphone. Thus, for example, the back surface 405 of port 401 in eartip 400 is moved away from the centerline to insure that it is not blocked when attached to sound delivery member 111.

Figure 8:
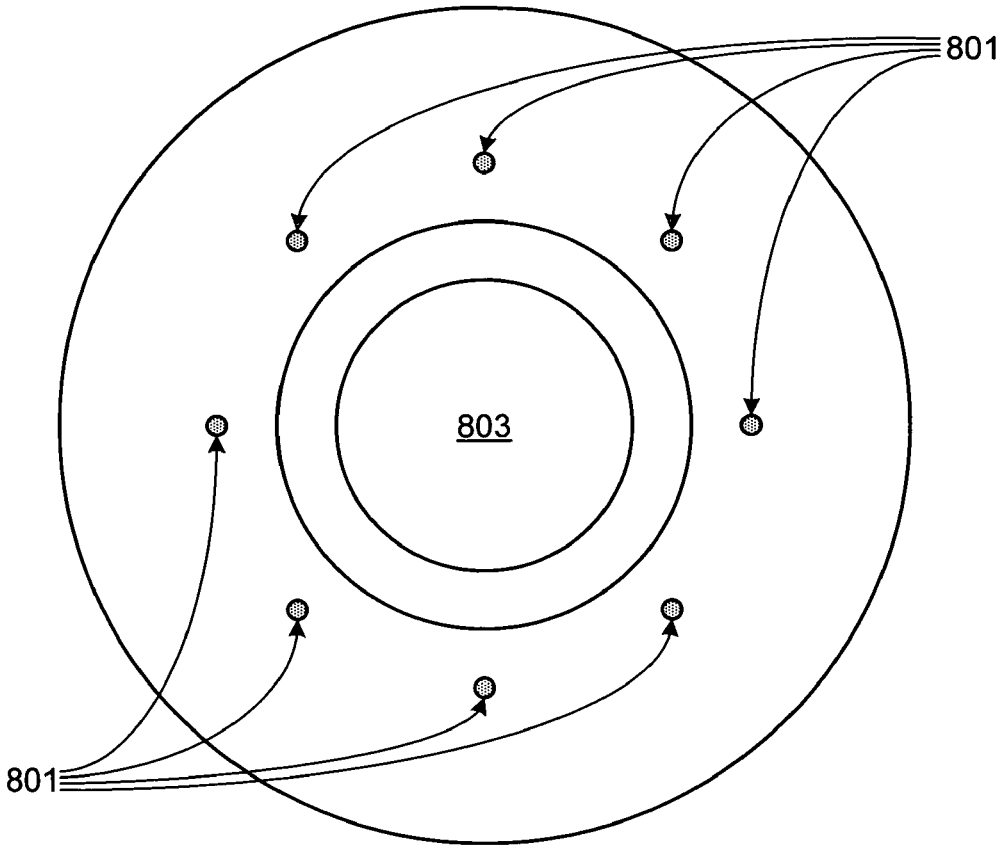
FIG. 8 is an end view of an eartip with multiple ports surrounding the central eartip opening.
Figure 9:
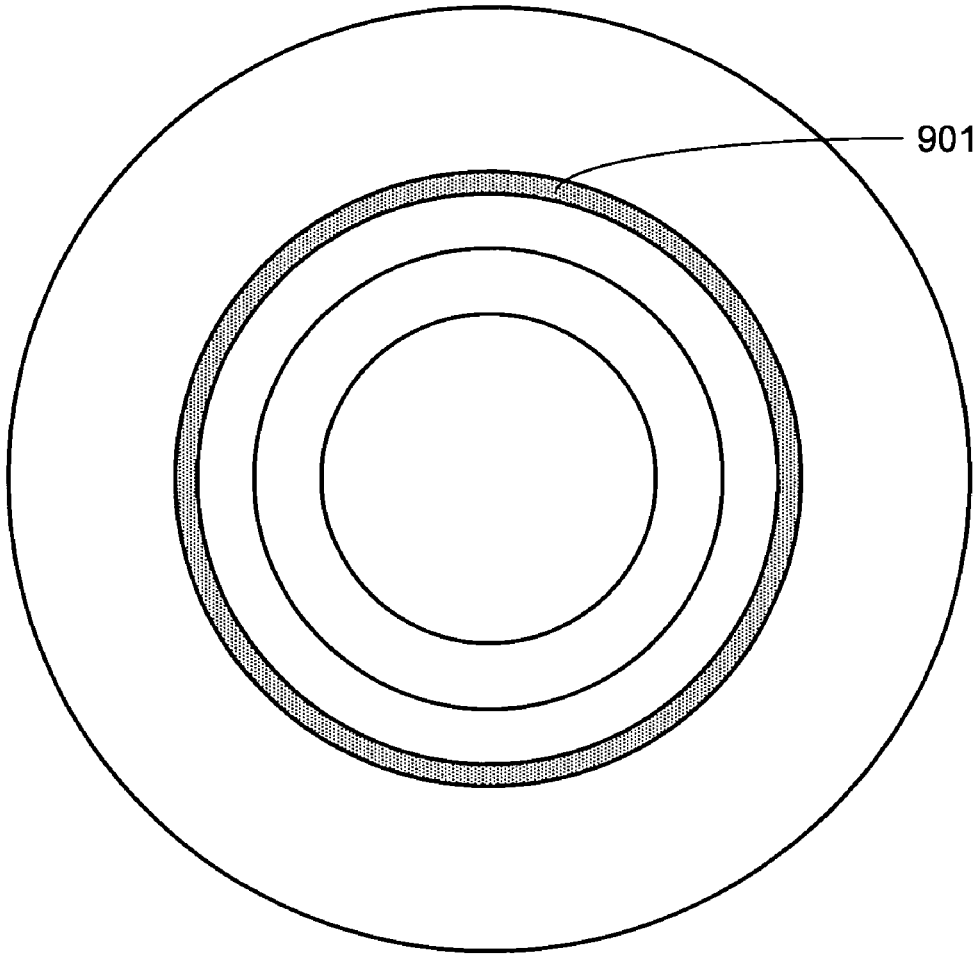
FIG. 9 is an end view of an eartip with a circular port surrounding the entire central eartip opening.
Figure 10:
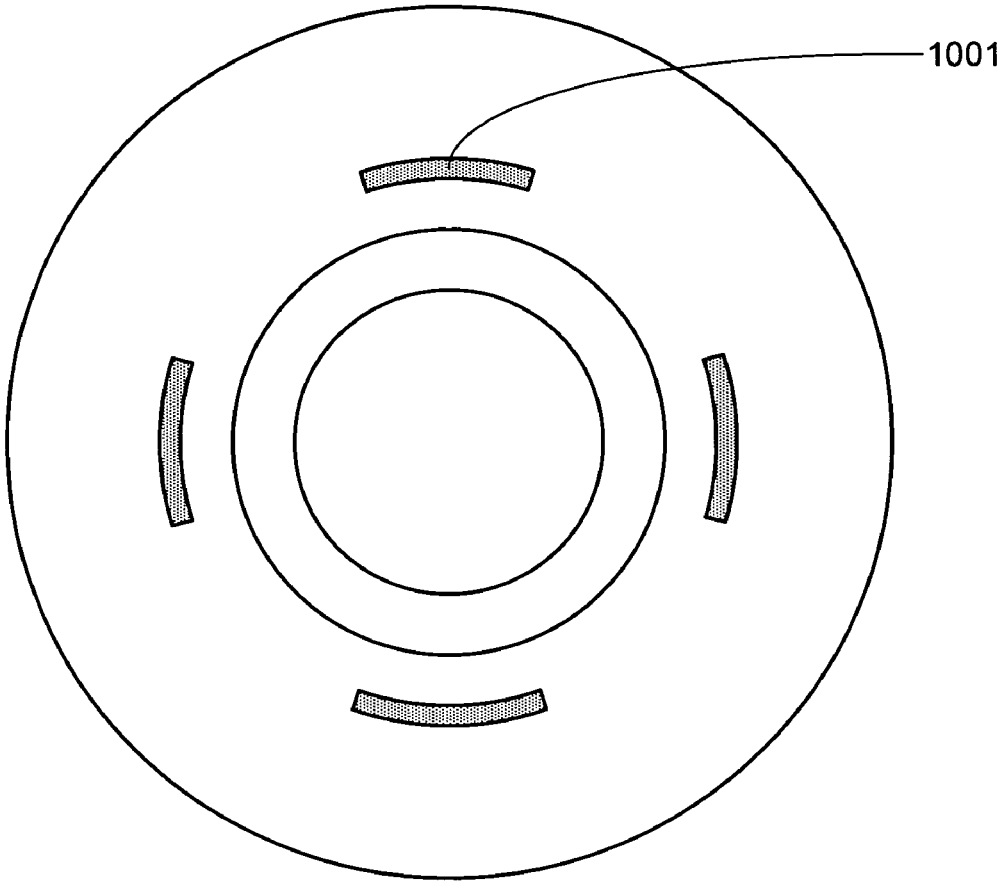
FIG. 10 is an end view of an eartip with multiple arcuate ports surrounding the central eartip opening.

It should be appreciated that there are countless designs for the port, depending upon the desired port area. For example, FIG. 8 is an illustration of an end view of an eartip with multiple ports 801 surrounding the central eartip opening 803. In the alternate design shown in FIG. 9, port 901 is circular, surrounding the entire central eartip opening. In another alternate design shown in FIG. 10, multiple arcuate ports 1001 surround the central eartip opening.

The acoustic material comprising the eartip acoustic ports of the invention can be fabricated from any of a variety of materials, although typically the material is either made of a foam or a fibrous material (e.g., woven cloth-like material). The acoustic material is selected on the basis of its acoustic impedance such that the selected material provides the desired acoustic transmission. If desired, the selected acoustic material can also be selected on the basis of its acoustic transmission for a specific range of frequencies, for example preferentially transmitting the range of frequencies that include voices and emergency sirens.

In a preferred embodiment of the invention, the user is provided with multiple eartip pairs, assuming a headset with both left and right channels, each eartip pair having a different acoustic impedance. Thus the user is able to tailor the acoustic properties of their headset for a particular use. Furthermore given the easy interchangeability of eartips, the user is able to quickly modify their headset as needed. Preferably each eartip includes an identifier such as a color code or other marking, thus allowing its acoustic properties to be quickly ascertained.

In addition to providing a means of adjusting the sound isolation properties of a set of earphones, the controlled leakage eartips of the present invention can also be used to adjust the frequency response of the earphones. As a result, it is possible for a single set of earphones to be adjusted to match the listening preferences of a variety of users. For example, the base response of a set of earphones can be easily adjusted by varying the leakage of the eartips.

As will be understood by those familiar with the art, the present invention may be embodied in other specific forms without departing from the spirit or essential characteristics thereof. Accordingly, the disclosures and descriptions herein are intended to be illustrative, but not limiting, of the scope of the invention which is set forth in the following claims.

What is claimed is:

1. An eartip fabricated from a first material and configured for coupling to an earphone, said eartip comprising:

a central opening within said eartip, said central opening configured to accept an earphone sound delivery member;

means for attaching said eartip to said earphone sound delivery member;

at least one port within said eartip, said at least one port forming at least one acoustic leakage pathway independent and separate from said earphone sound delivery member, wherein said at least one port is adjacent to said central opening, and wherein said acoustic leakage pathway couples ambient sound to an exit surface of said eartip; and acoustic material filling at least a portion of said at least one port, said acoustic material different from the first material used to fabricate the eartip, wherein said acoustic material is selected from the group of materials consisting of foam and fibrous material, and wherein said acoustic material is selected on the basis of its acoustic impedance.

2. The eartip of claim 1, wherein a first end of said at least one port is within a user ear canal during earphone use, and wherein a second end of said at least one port is positioned to receive ambient sounds during earphone use.

3. The eartip of claim 1, wherein said central opening is cylindrically shaped.

4. The eartip of claim 1, wherein said attaching means further comprises a first interlocking member on an exterior surface of said earphone sound delivery member and a second interlocking member on an inner surface of said central opening of said eartip.

5. The eartip of claim 1, wherein said attaching means further comprises a channel on an exterior surface of said earphone sound delivery member and a lip on an inner surface of said central opening of said eartip, wherein said lip fits within said channel when said eartip is attached to said earphone sound delivery member.

6. The eartip of claim 1, wherein said at least one port has a circular cross-section.

7. The eartip of claim 1, wherein said at least one port has an arcuate shaped cross-section.

8. The eartip of claim 1, wherein said at least one port is comprised of a plurality of ports surrounding said central opening.

9. The eartip of claim 8, wherein each of said plurality of ports has a circular cross-section.

10. The eartip of claim 8, wherein each of said plurality of ports has an arcuate shaped cross-section.

11. The eartip of claim 1, further comprising an indicator associated with an acoustic property of said eartip.

12. An eartip kit for use with a set of earphones, said eartip kit comprising:

a plurality of eartip pairs of varying acoustic impedance, wherein each eartip pair includes a first and a second eartip, and wherein each of said first and second eartips comprises:

a central opening configured to accept an earphone sound delivery member;

at least one port adjacent to said central opening, said at least one port forming at least one acoustic leakage pathway independent and separate from said earphone sound delivery member, and wherein said acoustic leakage pathway couples ambient sound to an eartip exit surface;

acoustic material filling at least a portion of said at least one port, wherein said acoustic material is selected from the group of materials consisting of foam and fibrous material, wherein said acoustic material defines said acoustic impedance of said eartip pair, and wherein said acoustic impedance of each eartip pair is different due to differences in said acoustic material selected for each eartip pair; and visual coding indicative of said acoustic impedance of said eartip pair.

13. The eartip kit of claim 12, wherein each eartip of each eartip pair of said plurality of eartip pairs further comprises a first interlocking member on an inner surface of said central opening configured to couple to a second interlocking member on an exterior surface of said earphone sound delivery member.

14. The eartip kit of claim 12, wherein each eartip of each eartip pair of said plurality of eartip pairs further comprises a lip on an inner surface of said central opening configured to fit within a channel on an exterior surface of said earphone sound delivery member.

15. The eartip kit of claim 12, wherein said at least one port has a circular cross-section.

16. The eartip kit of claim 12, wherein said at least one port has an arcuate shaped cross-section.

17. The eartip kit of claim 12, wherein said at least one port is comprised of a plurality of ports surrounding said central opening.

18. The eartip kit of claim 17, wherein each of said plurality of ports has a circular cross-section.

19. The eartip kit of claim 17, wherein each of said plurality of ports has an arcuate shaped cross-section.

* * * * *